US010119086B2

(12) United States Patent
Shotts

(10) Patent No.: US 10,119,086 B2
(45) Date of Patent: Nov. 6, 2018

(54) SYSTEM AND METHOD FOR RECOVERING NGL

(71) Applicant: Steve Shotts, Dallas, TX (US)

(72) Inventor: Steve Shotts, Dallas, TX (US)

(73) Assignee: COLDSTREAM ENERGY HOLDINGS, LLC, Dallas, TX (US)

( * ) Notice: Subject to any disclaimer, the term of this patent is extended or adjusted under 35 U.S.C. 154(b) by 447 days.

(21) Appl. No.: 15/042,774

(22) Filed: Feb. 12, 2016

(65) Prior Publication Data

US 2016/0238313 A1 Aug. 18, 2016

Related U.S. Application Data

(60) Provisional application No. 62/116,080, filed on Feb. 13, 2015, provisional application No. 62/156,552, filed on May 4, 2015.

(51) Int. Cl.
*F25J 3/02* (2006.01)
*C10L 3/12* (2006.01)

(52) U.S. Cl.
CPC ..... *C10L 3/12* (2013.01)

(58) Field of Classification Search
CPC ..... C10L 3/12; F25J 3/0209–3/0233
See application file for complete search history.

(56) References Cited

U.S. PATENT DOCUMENTS

2011/0000133 A1* 1/2011 Rhinesmith ..... B01J 8/0207 48/127.1

* cited by examiner

*Primary Examiner* — Cabrena Holecek
(74) *Attorney, Agent, or Firm* — Foley & Lardner LLP

(57) ABSTRACT

A system includes a water knock-out tank that receives a fluid material. Water from the fluid material settles on the bottom of the water knock-out tank. The system includes a mixing pipe that mixes a glycol with the fluid material transferred from the water knock-out tank and a first heat exchanger that cools the mixed fluid material and glycol. The system includes a gas-liquid separator that separates gaseous components and liquid components of the mixed fluid material and cooled glycol and a liquid-liquid separator that separates the liquid components of the mixed fluid material and cooled glycol by density. The system includes a fractional distillation column that heats a first liquid from the liquid-liquid separator. Heating the first liquid from the liquid-liquid separator gasifies a first portion of the first liquid. A second portion of the first liquid from the liquid-liquid separator remains liquid and is natural gas liquids.

20 Claims, 7 Drawing Sheets

SYSTEM AND METHOD FOR RECOVERING NGL

PRIORITY CLAIM

This application claims priority to U.S. Provisional Patent Application No. 62/116,080, filed Feb. 13, 2015, and to U.S. Provisional Patent Application No. 62/156,552, filed May 2, 2015, both of which are hereby incorporated by reference in their entirety.

TECHNICAL FIELD

The present disclosure relates to a system and method for recovering natural gas liquids.

BACKGROUND

The following description is provided to assist the understanding of the reader. None of the information provided or references cited is admitted to be prior art. In many instances, while producing natural gas, much of the natural gas contains natural gas liquids (NGLs), which are a byproduct of crude oil production and, in many cases, from natural gas production. It is often desirable to remove the NGLs from the natural gas, for example, before the natural gas is sold on the market. In many cases in the production of oil, the NGLs are sent to a flare to be destroyed as a waste stream.

SUMMARY

An illustrative system includes a water knock-out tank configured to receive a fluid material. Water from the fluid material settles on the bottom of the water knock-out tank. The system also includes a mixing pipe configured to mix a glycol with the fluid material transferred from the water knock-out tank and a first heat exchanger configured to cool the mixed fluid material and glycol. The system further includes a gas-liquid separator configured to separate gaseous components and liquid components of the mixed fluid material and glycol that has been cooled and a liquid-liquid separator configured to separate the liquid components of the mixed fluid material and glycol that has been cooled by density. The system also includes a fractional distillation column configured to heat a first liquid from the liquid-liquid separator. Heating the first liquid from the liquid-liquid separator causes a first portion of the first liquid to gasify. A second portion of the first liquid from the liquid-liquid separator remains liquid and is natural gas liquids.

An illustrative method includes separating free water from a fluid material. The fluid material comprises natural gas and natural gas liquids. The method also includes mixing the fluid material with a glycol, cooling the mixed fluid material and glycol, and separating gaseous components and liquid components of the mixed fluid material and glycol that has been cooled. The method further includes separating, by density, the liquid components of the mixed fluid material and glycol that has been cooled and heating a first liquid of the liquid components thereby causing a first portion of the first liquid to gasify. A second portion of the first liquid to remain liquid. The second portion of the first liquid is natural gas liquids.

The foregoing summary is illustrative only and is not intended to be in any way limiting. In addition to the illustrative aspects, embodiments, and features described above, further aspects, embodiments, and features will become apparent by reference to the following drawings and the detailed description.

Figure 1:
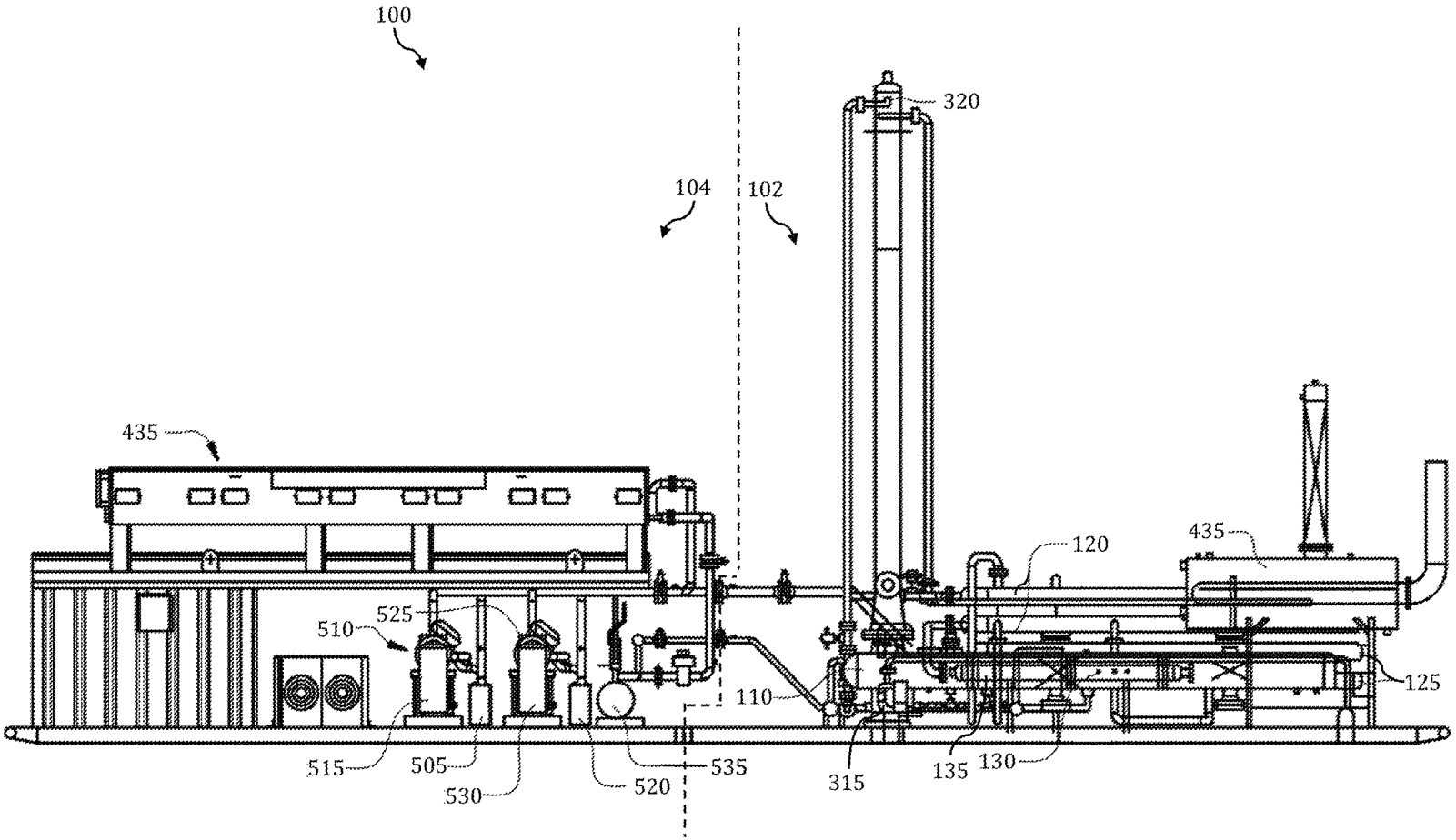
FIG. 1 is an elevation view of a skid for isolating natural gas liquids in accordance with an illustrative embodiment.

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

DETAILED DESCRIPTION

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

Crude oil and natural gas production sites are located in many places around the world. Often, the production sites are remote and relatively temporary. Thus, most equipment at a production site is often portable or disposable. The global market for crude oil and natural gas is competitive. Thus, it is often important to efficiently produce oil and gas. Natural gas liquids (NGLs) are often a byproduct of crude oil or natural gas production. NGLs can be processed into a useable and sellable product. In many instances, however, NGLs are wasted and burned, for example, in a flare system.

The ability to capture NGLs at production locations is not ordinarily feasible or practical, but offers economic and environmental advantages. At many production locations, natural gas and NGLs are not captured. In such instances, the natural gas and NGLs are vented to the atmosphere and/or incinerated using a flare. Venting or burning NGLs is detrimental to efficiency and the environment. For example, venting or burning NGLs can produce greenhouse gasses that may contribute to detrimental environmental effects. By not capturing the NGLs into a useable form, the energy stored within the NGLs is wasted (e.g., via a flare).

Captured NGLs can be sold as a useable product. As an example, Y-Grade NGLs were sold for about $0.45 per gallon in 2015. Thus, various embodiments allow a product that is usually treated as a waste stream at remote production sites to be monetized. In an illustrative embodiment, a natural gas production site that produces a rich stream of natural gas at a flow rate of 3,000 thousand standard cubic feet per day (MSCFD) can recover between 11,000 and 20,000 gallons of NGLs per day. Thus, the NGLs could be sold in the 2015 market for about $4,950 to $9,000 per day.

The various embodiments and techniques described herein allow efficient processing of the NGLs. By increasing efficiency of the system, greater profits can be obtained, less energy can be used, more pure product can be made, etc. Some embodiments described herein can be 150% to 300% more efficient than exiting systems for extracting NGLs. Some embodiments described herein are more efficient because natural gas and NGLs are processed at the well location instead of at a remote facility, thereby reducing the amount of energy and infrastructure required for transportation. Some embodiments use small form factor equipment that reduces the size of the overall system, which, in turn, may reduce the amount of pressure drop across the system. Greater refrigeration compressor power may also result in greater efficiency.

FIG. 1 is an elevation view of a skid for isolating natural gas liquids in accordance with an illustrative embodiment. An illustrative skid 100 includes a separator 110, a heat exchanger 120, a heat exchanger 125, a heat exchanger 130, a heat exchanger 135, a heat exchanger 315, a tower 320, a glycol reboiler 435, a suction accumulator 505, a compressor 510, an oil separator 515, an suction accumulator 520, a compressor 525, an oil separator 530, and a liquid receiver 535. In alternative embodiments, additional, fewer, and/or different elements can be used. FIG. 1 is meant to be illustrative only and is not meant to be limiting with respect to the size, shape, orientation, configuration, etc. of the various elements.

In an illustrative embodiment, the skid 100 includes a refrigeration skid 104 and a process skid 102. As discussed in greater detail below, the skid 100 can include a refrigeration system, which can be located (primarily) on the refrigeration skid 104. As illustrated in FIG. 1, the refrigeration skid 104 and the process skid 102 can be connected to form the skid 100. In an illustrative embodiment, the equipment on the process skid 102 can be connected to, disconnected from, and separated from the equipment on the refrigeration skid 104. The dotted line of FIG. 1 illustrates the boundary between the refrigeration skid 104 and the process skid 102 in accordance with an illustrative embodiment. In alternative embodiments, the boundary can be relocated, adjusted, etc. Pipe connections made between the refrigeration skid 104 and process skid 102 can be connected and disconnected using flanges or any other suitable connection. Each of the refrigeration skid 104 and the process skid 102 can include respective equipment (e.g., the separator 110, the heat exchanger 120, the liquid receiver 535, etc.) mounted on beams. The beams can be located at the bottom of the refrigeration skid 104 and the process skid 102. Thus, each of the refrigeration skid 104 and process skid 102 can be transported (e.g., via a truck) without disassembling all (or most) of the pipes, vessels, motors, etc. In such embodiments, the refrigeration skid 104 and the process skid 102 can be transported separately by disconnecting piping (and electrical connections) at the dotted line boundary. The mobility of the refrigeration skid 104 and the process skid 102 facilitates relatively quick and easy deployment of the skid 100 at remote locations (e.g., drill sites).

In alternative embodiments, the various locations of the equipment can be located on either the refrigeration skid 104 or the process skid 102 (or on a different skid). In some embodiments, more than two separable skids are used. In alternative embodiments, the skid 100 is not separable into a refrigeration skid 104 and a process skid 102. In some embodiments, the skid 100 is mounted and/or installed at a site permanently.

In an illustrative embodiment, the refrigeration skid 104 and the process skid 102 have different electrical classifications. The National Fire Protection Association (NFPA) sets forth various standards for electrical safety in the National Electrical Code® (NEC). Article 500 of the NEC describes the classification of areas based on the flammability of the materials in the area. In some classifications, such as Class I, Div. 2, electrical equipment should be housed in explosion-proof housings and extra care must be taken to prevent flammable material from being ignited by the electrical equipment. In many instances, instruments, motors, and other electrical equipment that are rated for Class I, Div. 2 areas (or other classified areas) cost significantly more than equipment suitable for non-classified areas. Further, in some instances, installation costs of electrical equipment for use in a classified area is more expensive than in non-classified areas.

In some embodiments, the materials processed on the process skid 102 cause the area of and around the process skid 102 to be classified (e.g., Class I, Div. 2). In some embodiments, the materials processed on the refrigeration skid 104 are non-flammable and the area of the refrigeration skid 104 can be non-classified. Thus, in embodiments in which multiple skids are used, the process skid 102 can use explosion-proof electrical equipment and the refrigeration skid 104 can use electrical equipment suitable for non-classified areas.

In an illustrative embodiment, the various equipment and piping are located to reduce the footprint of the skid 100. For example, four heat exchangers can be stacked above one another to reduce the footprint required. In an illustrative embodiment, the assembled skid 100 has a footprint of about 8.5 feet wide by about 62 feet long. In some embodiments, the skid 100 is 8.5 feet wide or less to facilitate transportation of the skid 100 via roads and special transportation permits are not required. Any suitable size skid 100 can be used. In an illustrative embodiment, additional structure (e.g., ladders, support, frames, etc.) can be used on the skid 100. In some embodiments, some or all of the skid 100 can be covered and/or be indoors.

The various pipes, vessels, valves, instruments, etc. of the skid 100 can be made of any suitable material. For example, the materials of construction for wetted parts can be steel, carbon steel, stainless steel, lined steel (e.g., polytetrafluoroethylene), alloys, etc. In an illustrative embodiment, the various components are designed and built in accordance with industry standards, regulations, etc. (e.g., ASME Section VIII and ASME B31.3 for natural gas vessels and piping). The various pipes, vessels, valves, instruments, etc. can be rated for any suitable pressure. In an illustrative embodiment, the various components are rated for at least 1,420 pounds per square inch gage (psig).

FIGS. 2-5 are process flow diagrams in accordance with an illustrative embodiment. In alternative embodiments, additional, fewer, and/or different elements may be used. FIGS. 2-5 show the same elements, with different elements labeled for ease of discussion. Although not shown in FIGS. 2-5, process material can flow through the various pipes and vessels via pressure that is generated by equipment or processes not shown in FIGS. 2-5.

The process flow diagrams of FIGS. 2-5 use depictions of vessels, instruments, valves, etc. that are commonly used in one or more industries to depict specific features or types of the vessels, instruments, valves, etc. In alternative embodiments, any suitable vessels, instruments, valves, etc. may be used. The process flow diagrams are diagrammatical and are not meant to be limiting with respect to orientation, distance, configuration, etc. Arrows used to indicate flow direction are meant to be illustrative only. In alternative embodiments or different modes of operation (e.g., during cleaning), flows can be reversed in one or more of the lines.

FIGS. 2-5 are intended to show the flow and processing of material in accordance with an illustrative embodiment and are not meant to be limiting with respect to structure, pipe and equipment layout, location of equipment such as pumps, instrumentation, and valves, etc. In some embodiments, equipment is used that is not illustrated in FIGS. 2-5 (e.g., pumps, instruments, valves, etc.).

FIGS. 2-5 illustrate material inputs to and outputs from the skid 100. The inlet gas 192 is transferred to the skid 100 via piping, hosing, etc. The skid 100 outputs lights output 198, natural gas liquids output 196, natural gas output 194, and water output 190. In some embodiments, the outputs from the skid 100 can include one or more contaminants, impurities, etc. For example, the water output 190 can output water with other materials suspended in, dissolved in, mixed with, etc. the water.

The inlet gas 192 can be any suitable stream of materials that includes NGLs. In some embodiments, the inlet gas 192 is provided from gas wells or oil wells as associated gas. In some instances, the associated gas contains more hydrocarbons than gas from gas wells. As an example, gas and oil are sourced from wells in the earth. Natural pressure in the earth can force the gas and oil up to the surface, or pumps (e.g., pumps on the surface or pumps in the well) can be used to suction the gas and oil to the surface. In some instances, material can be forced into the ground to increase the well pressure, thereby forcing the oil and gas up to the surface through the well. The oil and gas can be separated from one another by mechanical or thermal methods. Any suitable method for separating the oil from the gas can be used. In an illustrative embodiment, $H_2S$ is removed from the gas before being supplied to the system via the inlet gas 192. In some embodiments, pressure from the well or from one or more pumps can supply pressure to drive the inlet gas 192 (and the various other process materials and lines) through the skid 100.

In an illustrative example, the inlet gas 192 can be rich (e.g., with relatively large amounts of ethane and/or propane compared to the percentage of methane) or lean (e.g., with relatively large amounts of methane and relatively little amounts of ethane and/or propane). In an illustrative embodiment, rich inlet gas 192 can include about 70% methane, 15% propane (plus), and 15% ethane. In an illustrative embodiment, lean inlet gas 192 includes about 87% methane, 6% ethane, and 4% propane (plus). In an illustrative embodiment, the inlet gas 192 is a natural gas stream output by a production well.

In an illustrative embodiment, the skid 100 includes a separator 110. The separator 110 includes a water knock-out section 112, a gas-liquid separator 114, and a liquid-liquid separator 116. In some embodiments, including the water knock-out section 112, the gas-liquid separator 114, and the liquid-liquid separator 116 into the same vessel provides some advantages. For example, the skid 100 may have a smaller footprint. With the various components of the separator 100 in the same vessel, pipe routes can be simplified. In an illustrative embodiment, the water knock-out section 112, the gas-liquid separator 114, and the liquid-liquid separator 116 are separated volumes within the separator 110. In alternative embodiments, the separator 110 may be multiple vessels. For example, the water knock-out section 112 may be in a vessel separate from the gas-liquid separator 114 and/or the liquid-liquid separator 116. Any suitable configuration of the separator 110 may be used.

Figure 2:
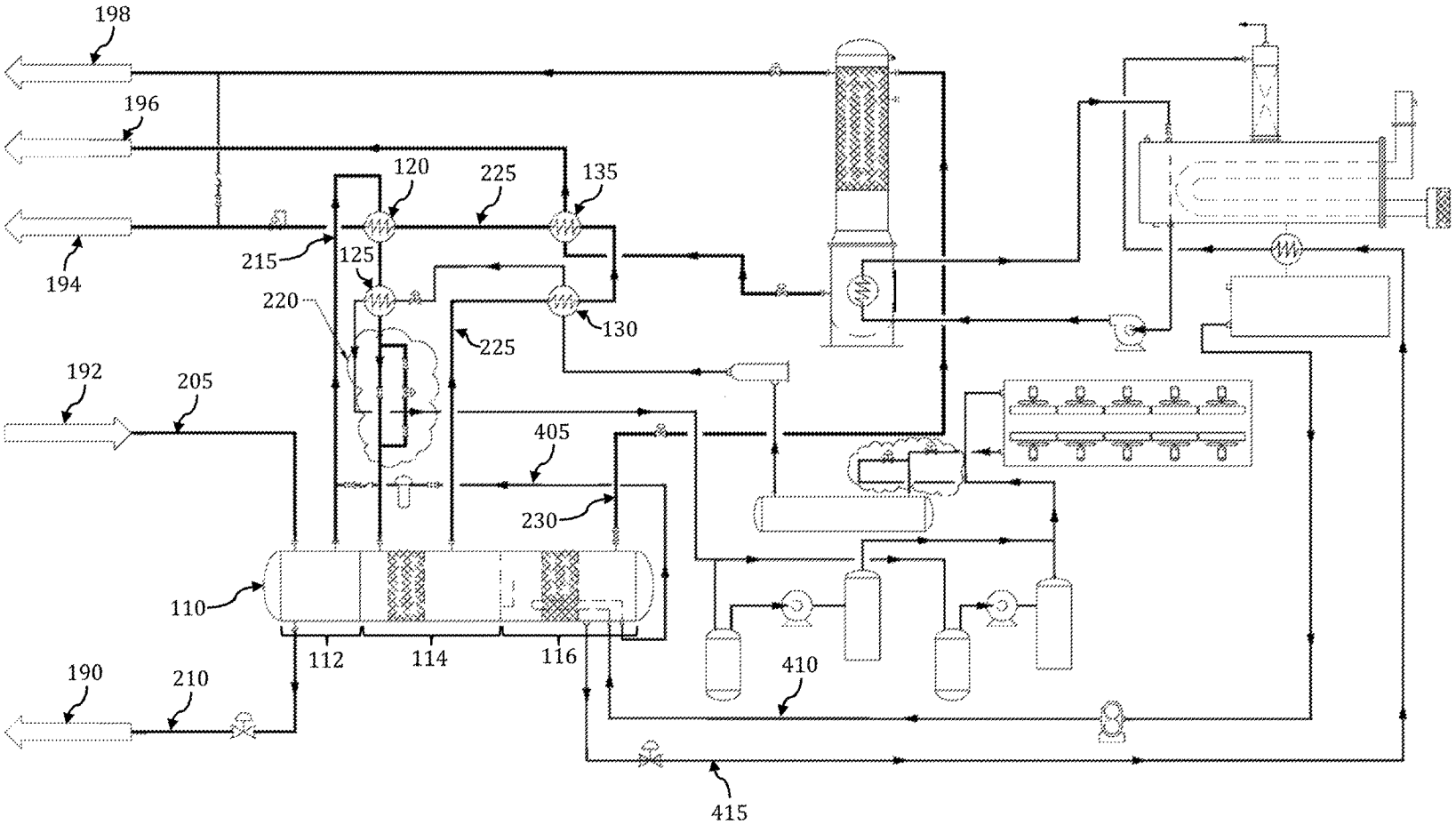
FIGS. 2-5 are process flow diagrams in accordance with an illustrative embodiment.

As shown in FIG. 2, the inlet gas 192 is transported to the water knock-out section 112 via the inlet gas line 205. In an illustrative embodiment, the inlet gas 192 includes natural gas, NGLs, water, and other components. In some embodiments, the inlet gas 192 includes natural gas that is saturated with water. In other embodiments, the inlet gas 192, includes free water that is not entrained in the natural gas.

The inlet gas 192 can be introduced into the skid 100 at any suitable temperature or pressure. For example, the inlet gas 192 has a temperature of between 70° F. and 100° F. In alternative embodiments, the inlet gas 192 has a temperature of below 70° F. or above 100° F. In an example, the inlet gas 192 has a pressure of between 250 psig and 1,420 psig. In some embodiments, the temperature and/or pressure of the inlet gas 192 can be altered by one or more compressors. In some embodiments in which the inlet gas 192 is compressed, heavier hydrocarbons may fall out (e.g., precipitate out) of the inlet gas 192 as condensate. The condensate that fall out may be collected and processed using any suitable method.

The inlet gas 192 can be introduced into the skid 100 at any suitable flowrate. In some embodiments, the inlet gas 192 flows into the skid 100 at a rate of between 500 thousand standard cubic feet per day (MSCFD) and 7,000 MSCFD. In alternative embodiments, the inlet gas 192 flows into the skid 100 at a flowrate of less than 500 MSCFD or greater than 7,000 MSCFD. The amount of natural gas output 194 by the skid 100 can be dependent on the amount of inlet gas 192 input into the skid 100. For example, the inlet gas 192 flows into the skid 100 at a rate of 7,000 MSCFD and the flowrate of the natural gas output 194 is about 6,300 MSCFD. The amount of natural gas output 194 can also be dependent on the amount of NGLs in the inlet gas 192. For example, the higher percentage of NGLs in the inlet gas 192, the less natural gas output 194 will be produced for a given flowrate of the inlet gas 192.

In an illustrative embodiment, the skid 100 can operate as low as 15% of maximum capacity. The skid 100 can have any suitable capacity. For example, the skid 100 can process 2,000 MCFD, 3,500 MCFD, 5,000 MCFD, 10,000 MCFD, etc. of input gas. In an illustrative embodiment, the minimum capacity can be 500 MCFD.

The water knock-out section 112 separates the water from the inlet gas 192. In some embodiments, removing the water (e.g., free water) from the inlet gas 192 is beneficial to the processes and/or equipment of the skid 100. For example, if the water is not removed from the inlet gas 192, the water can freeze in piping, valves, vessels, etc. In some instances, the water can form hydrates with carbon dioxide, hydrocarbons, or other hydrates. For example, the hydrates can form at relatively high temperatures and can plug valves, piping, etc. In some instances, as one or more process streams are cooled or the pressure in the streams is decreased, the water can precipitate out of the process material. Free water combined with carbon dioxide can cause corrosion. In some embodiments, the water knock-out section 112 is not used.

The inlet gas line 205 can attach to a port located at any suitable location of the water knock-out section 112. In some embodiments, a diverter plate within the water knock-out section 112 facilitates separation of liquid from gas. In an illustrative embodiment, the diverter plate is a plate that is parallel to the flow of fluid into the water knock-out section 112. The fluid flows into the diverter plate and sprays into the volume of the water knock-out section 112. In alternative embodiments, any suitable diverter plate may be used. As illustrated in FIG. 2, the inlet gas line 205 may connect to a port that is on the top of the water knock-out section 112. In an illustrative embodiment, the water line 210 connects to the water knock-out section 112 via a port on the bottom of the water knock-out section 112. In alternative embodiments, the water line 210 connects to the water knock-out section 112 at any suitable location. Within the water knock-out section 112, liquid can be separated from gas. For example, liquid falls to the bottom of the water knock-out section 112 and gas rises to the top of the water knock-out section 112. In an illustrative embodiment, the level of the liquid in the water knock-out section 112 can be controlled, for example, via a control valve in the water line 210. Any suitable method of controlling the level of the liquid can be used. The water line 210 can transport liquids (e.g., free water) that fall out of the inlet gas 192 in the water knock-out section 112 to the water output 192. In an illustrative embodiment, the liquids can be transported from the water output 192 to an unpressurized tank. The liquids can be disposed of.

Gas from the water knock-out section 112 can be transported from the water knock-out section 112 to the gas-liquid separator 114 from the water knock-out section 112. Glycol from the glycol line 405 can be introduced to the gas via glycol line 405. The glycol mixed with the gas can be cooler than the gas. The glycol and the gas can be mixed using any suitable method, such as by creating turbulences in the stream. For example, bends, elbows, etc. in the gas-glycol line 215 can create turbulences.

Glycol is used to dehydrate the gas from the water knock-out section 112. The glycol attaches to the water in the gas from the water knock-out section 112, and the glycol/water compound can be relatively easy to separate from natural gas. As used herein, "glycol" refers to any suitable glycol (or other chemicals) for dehydrating fluids. For example, glycol can include triethylene glycol (TEG), diethylene glycol (DEG), monoethylene glycol (MEG), and/or tetraethylene glycol (TREG). In an illustrative embodiment, glycol comprises a mixture of 75% ethylene glycol and 25% water.

In an illustrative embodiment, the gas/glycol mixture in the gas-glycol line 215 passes through the heat exchanger 120 and the heat exchanger 125. The heat exchanger 120 and the heat exchanger 125 cool the gas/glycol mixture. In some instances, the heat exchanger 125 can be referred to as a "chiller." In an illustrative embodiment, the control piping 220 is used to control the flow through the gas-glycol line 215. For example, a control valve in the control piping 220 can be used to control the flow of liquid refrigerant to the heat exchanger 125. The gas-glycol line 215 connects to a port on the gas-liquid separator 114 at any suitable location. For example, the gas-liquid separator 114 can connect to a port on the top of the gas-liquid separator 114.

The gas-liquid separator 114 can separate liquid from gas. For example, the glycol/water compounds and NGLs can be separated from natural gas. In some embodiments, the gas-liquid separator 114 includes packing or other material that facilitates separation from the glycol/water compounds from the natural gas. For example, the packing is housed in a cylinder with a diameter of eighteen inches and a length of two feet. The packing can be 2.8 cubic feet in volume. In alternative embodiments, any suitable shape and volume can be used. Thus, within the gas-liquid separator 114, natural gas rises to the top and liquids fall to the bottom. The liquids can contain water, glycol, and NGLs.

In an illustrative embodiment, the natural gas from the gas-liquid separator 114 is transported from the gas-liquid separator 114 via the natural gas line 225. In an illustrative embodiment, the natural gas from the gas-liquid separator 114 has a temperature of about −20° F. In an illustrative embodiment, the natural gas passes through the heat exchanger 130, the heat exchanger 135, and the heat exchanger 120 to warm the natural gas. The natural gas can be transported to the natural gas output 194 via the natural gas line 225. The natural gas output 194 can be connected to pipes, hoses, etc. to a natural gas pipeline, a storage tank, a flare, etc. In an illustrative embodiment the natural gas output 194 is a dry natural gas. For example, the dry natural gas can have a moisture content of less than 1 pound per million cubic feet (lb./MMCF). In an illustrative embodiment, the dry natural gas has less than 0.5 lb./MMCF of water. In one embodiment, the dry natural gas has less than 0.01 lb./MMCF of water. In some embodiments, the dry natural gas has been stripped of most or all of the NGLs. In an illustrative embodiment, the dry natural gas has a higher percentage of methane than the inlet gas 192.

In an illustrative embodiment, the liquid from the gas-liquid separator 114 is transported to the liquid-liquid separator 116. Any suitable method can be used. For example, an "L" shaped tube can be attached to the separator between the gas-liquid separator 114 and the liquid-liquid separator 116 (e.g., as illustrated in FIG. 2). Liquid from the bottom of the gas-liquid separator 114 can be transported through the "L" shaped tube and to the top or middle of the liquid-liquid separator 116. In some embodiments, the flow of liquid from the gas-liquid separator 114 to the liquid-liquid separator 116 is controlled to control the liquid level of the gas-liquid separator 114 and/or the liquid-liquid separator 116.

In an illustrative embodiment, the liquid-liquid separator 116 facilitates a phase separation (e.g., a phase break) of the liquid from the gas-liquid separator 114. For example, the liquid in the liquid-liquid separator 116 separates such that the water/glycol compounds sink to the bottom of the liquid-liquid separator 116 and the NGLs rise to the top of the liquid-liquid separator 116. In an illustrative embodiment, the water/glycol mixture has a density of about 1.10 grams per cubic centimeter ($g/cm^3$) to 1.15 $g/cm^3$ whereas the NGLs have a density of between 0.5 $g/cm^3$ and 0.8 $g/cm^3$. In an illustrative embodiment, packing can be used to facilitate the phase separation of the liquid within the liquid-liquid separator 116. For example, the packing can have a diameter of about 18 inches and can be about 3 feet long. The packing can contain about 4.2 cubic feet of packing. The water/glycol compound can be transported from the liquid-liquid separator 116 via the glycol line 415. The NGLs can be transported from the liquid-liquid separator 116 via the NGLs line 230.

As explained above, glycol is introduced to the gas as the gas leaves the water knock-out section 112. The gas/glycol mixture is cooled and the glycol is not separated from the NGLs until the NGLs are transferred from the liquid-liquid separator 116. In alternative embodiments, any suitable order or arrangement can be used. In the embodiment illustrated in FIGS. 2-5, the glycol remains in contact with the process material until the NGLs are removed in the liquid-liquid separator 116. Allowing prolonged contact of the glycol with the process material allows the glycol more time to absorb water from the process material. Further, by cooling the gas/glycol mixture (e.g., via the heat exchanger 125), the formation of hydrates is eliminated (or significantly reduced). For example, the glycol binds to water molecules, thereby lowering the temperature at which hydrates are formed.

Figure 3:
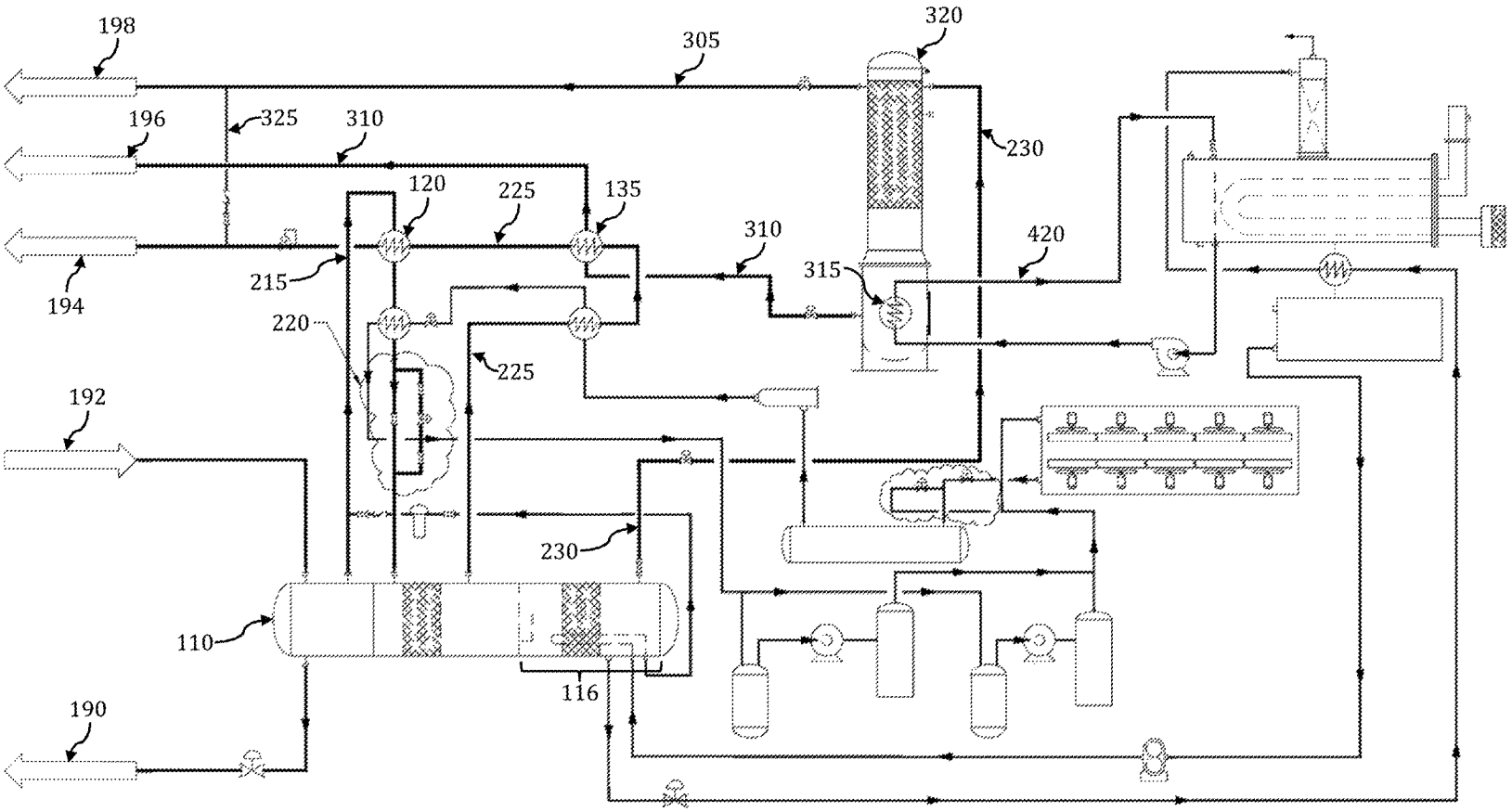

Referring to FIG. 3, the top phase of the liquid-liquid separator 116 is transported to the tower 320 via the NGLs line 230. In an illustrative embodiment, the NGLs line 230 is a fractional distillation column. In an illustrative embodiment, the NGLs line 230 is connected to the tower 320 at a port at the top of the tower 320. In alternative embodiments, the NGLs line 230 is connected to the tower 320 at any suitable location. The tower 320 can be a relatively tall, cylindrical vessel. The tower 320 can include packing that facilitates separation of lights from the NGLs. For example, the packing can have a diameter of about 12 inches and a length of about 20 feet. The packing can be about 15.75 cubic feet in volume.

In an illustrative embodiment, the lights include methane, ethane, propane, and/or butanes. The composition of the lights can be dependent upon the temperature and pressure of the process material in the tower 320. For example, as the temperature is increased, the the lights can include components with a higher boiling point. In an illustrative embodiment, as the pressure is decreased, the temperature decreases, thereby producing more liquid. In such an embodiment, the lights have fewer components with higher boiling points. In an illustrative embodiment, the NGLs in the NGLs line 230 is approximately between 19 mole % and 29 mole % ethane. In alternative embodiments, the amount of ethane in the NGLs line 230 depends upon the composition of the material in inlet gas 192. For example, in some embodiments, the NGLs line 230 is less than 19 mole % ethane or greater than 29 mole % ethane.

In an illustrative embodiment, the lights rise to the top of the tower 320. The lights can be in a gaseous phase. The lights line 305 can transport the lights from the top of the tower 320 to the lights output 198. In an illustrative embodiment, the lights output 198 is about 200 psig (or greater) and is about 0° F. The lights output 198 can be mostly methane and/or ethane. In some embodiments, the composition of the lights output 198 depends upon the temperature of the tower 320. For example, when the tower 320 is run at higher temperatures, the lights output 198 contains more components with a higher boiling point, and when the tower 320 is run at lower temperatures, the lights output 198 contains fewer components with a higher boiling point.

In an illustrative embodiment, some or all of the lights of the lights line 305 are mixed with natural gas in the line natural gas line 225 and are transported to the natural gas output 194. In some embodiments, the lights line 325 is not used. The amount of mixing of the lights of the lights line 305 and the natural gas in the natural gas line 225 can be dependent upon the richness of the natural gas in the natural gas line 225. "Rich" natural gas can refer to a natural gas with a high level of hydrocarbons. Rich natural gas has a higher heat content per unit volume than lean natural gas. Although not illustrated in FIG. 3, in some embodiments, the lights in the lights line 325 are cooled using a heat exchanger.

In some embodiments, the lights from the lights output 198 are transported to a compressor that compresses the lights. The lights can be used for any suitable purpose. For example, the lights can be sold. In another example, the lights can be burned for heat in one or more heat exchangers (e.g., reboilers), generators, etc. In yet another example, the lights can be burned in a generator, turbine, microturbine, etc. to provide electricity (e.g., to power one or more electrical components of the skid 100).

In an illustrative embodiment, the process material from the NGLs line 230 in the tower 320 separates into gas form (which is transported via the lights line 305) and liquid form. The liquids fall through the packing of the tower 320 to the bottom of the tower 320. The heat exchanger 315 can be used to increase the temperature of the process material in the bottom of the tower 320. In some instances, the heat exchanger 315 can be referred to as a "gas/gas heat exchanger," a "tower bottoms exchanger," and/or a "tower reboiler." In an illustrative embodiment, the heat exchanger 315 is a reboiler. In some instances, reboilers are heat exchangers that provide heat to a process vessel. For example, the liquid at the bottom of the tower 320 are heated to facilitate separation of the vapors that are transported via lights line 305. In an illustrative embodiment, warm (or hot) glycol is transported to the heat exchanger 315 via glycol line 420. In alternative embodiments, any suitable method for providing heat to the tower 320 can be used.

The lights are boiled off of the liquid in the tower 320, leaving (mostly) NGLs. The NGLs can be transported to the natural gas liquids output 196 via the NGLs line 310. In an illustrative embodiment, the NGLs line 310 connects to the tower 320 via a port at the bottom of the tower 320. In alternative embodiments, the NGLs line 310 can connect to the tower 320 at any suitable location. In an illustrative embodiment, the temperature of the process material in the tower 320 and the flow of the process material through the NGLs line 310 can be controlled such that the NGLs through the NGLs line 310 contains less than about 10 ppm of ethane and/or about 4 mole % ethane. In alternative embodiments, the NGLs line 310 contains any suitable composition (e.g., to meet transportation specifications). For example, in some instances, the NGLs through the NGLs line 310 contains more than 4 mole % ethane. The NGLs in the NGLs line 310 can pass through the heat exchanger 135. For example, the warm NGLs transfer heat to the natural gas in the natural gas line 225. The warm NGLs can be cooled for convenience and/or safety. In some embodiments, the heat exchanger 135 is not used. In some embodiments, the liquid level at the bottom of the tower 320 is controlled to be at a predetermined setpoint level.

The natural gas liquids output 196 can comprise any suitable material referred to as a natural gas liquid. For example, the natural gas liquids output 196 can comprise hydrocarbons such as ethane, propane, butane, pentanes, etc. The natural gas liquids output 196 can be referred to as Y-Grade. In an illustrative embodiment, the natural gas liquids output 196 has less than 4 mole % ethane. in an illustrative embodiment, the natural gas liquids output 196 can be a liquid at about 100° F. at about 250 pounds per square inch absolute (psia) at a flowrate of about 11,000 gallons per day to about 20,000 gallons per day. In alternative embodiments, the natural gas liquids output 196 has a temperature less than or greater than 100° F. For example, the natural gas liquids output 196 can be at ambient temperature. In another example, the temperature of the NGLs leaving the tower 320 is about 180° F. to about 192° F. and the NGLs pass through the heat exchanger 135 and leave the heat exchanger 135 at about 90° F. to about 100° F. In some embodiments, the natural gas liquids output 196 has a pressure of less than 250 psia. In alternative embodiments, the flowrate of the natural gas liquids output 196 is greater than or less than 11,000 gallons per day to about 20,000 gallons per day. In some instances, about 3,000 to 30,000 gallons of NGLs are captured each day. For example, the skid 100 can output 12,000 NGLs per day. In an illustrative embodiment, the natural gas liquids output 196 is a stabilized liquid and is ready to be transported (e.g., via a tanker truck, a rail tanker). In an illustrative embodiment, the natural gas liquids output 196 is coupled to a tank, a pipeline, a transport tank, etc.

In an illustrative embodiment, temperature of the various process materials within the various pipes and vessels can be controlled to most effectively facilitate the various chemical and/or physical processes and separation of the various components of the inlet gas 192. As discussed above, glycol can be used to dehydrate the gas in the gas-glycol line 215. Glycol can be used, for example, in heat exchangers to transfer heat with various process materials. In some instances, refrigerant can be used, for example, in heat exchangers to transfer heat with various process materials. The amount of glycol and/or refrigerant that passes through the heat exchangers can be controlled to thereby control the amount of heat transferred. In some embodiments, the amount of process material that passes through the heat exchanger can be controlled to control the amount of heat transferred.

Figure 4:
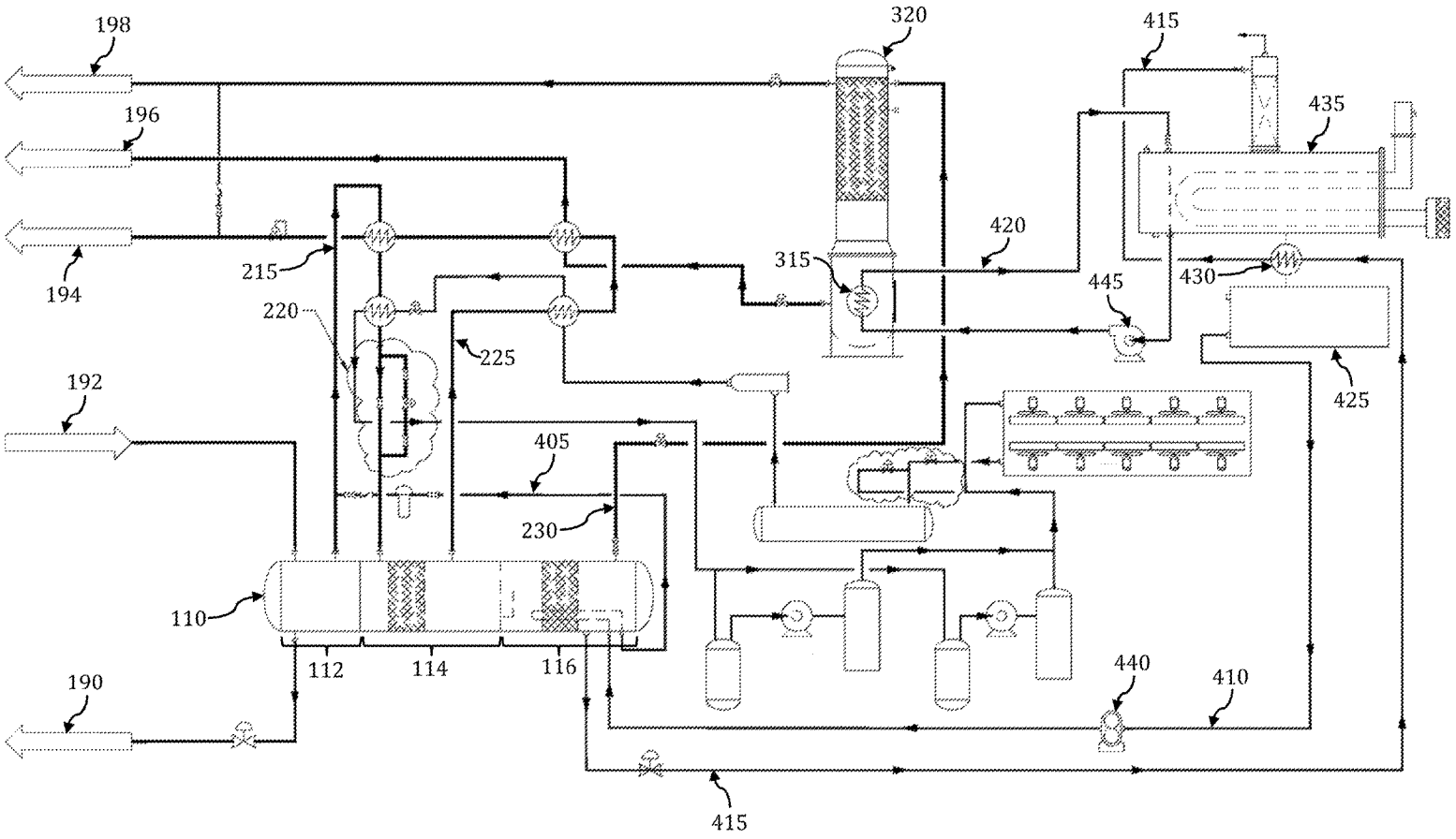

Referring to FIG. 4, in some instances, glycol is used to provide heat to the process materials. In an illustrative embodiment, the glycol reboiler 435 is used to heat the glycol within the glycol system. For example, heating the glycol can remove water (or other impurities) from the glycol. Any suitable method can be used to heat the glycol. For example, lights from the lights output 198 and/or oil can be burned to provide heat to the glycol. In some embodiments, the glycol reboiler 435 can be (or include) a hot oil heat exchanger. In alternative embodiments, any suitable fuel is used to provide heat to the glycol. The glycol reboiler 435 can be capable of producing a heating capacity of 500,000 British thermal units per hour (BTU/hour). In some embodiments, the glycol reboiler 435 produces up to 2,500,000 BTU/hr. For example, the glycol reboiler 435 can include a Flameco Industries SB18-skid 100 flame arrested burner to provide heat to the glycol.

In some embodiments, the glycol is heated to remove water via flash separation. For example, the temperature to which the glycol is heated is a temperature sufficient to flash off (at least some) the water but not to flash off the glycol. In an illustrative embodiment, the glycol reboiler 435 heats the glycol to a temperature between about 240° F. and about 295° F. In alternative embodiments, the glycol is heated to a temperature less than 240° F. or above 295° F.

As discussed above, glycol can be used to dehydrate the process material. In some embodiments the process material is not dehydrated. In embodiments in which the process material is dehydrated, the skid 100 can be run when ambient temperatures are as low as −20° F. For example, if the water is taken out of the process material, there is less freezing of material within the vessels, pipes, valves, etc. Further, by dehydrating the process material, the process material can be cooled to temperatures as low as −50° F.

In an illustrative embodiment, glycol from the glycol reboiler 435 is transferred to the glycol surge tank 425. In the embodiment illustrated in FIG. 4, warm glycol from the glycol reboiler 435 is transferred through the heat exchanger 430 to warm the glycol from the glycol line 415. In alternative embodiments, the heat exchanger 430 is not used. Warm glycol from the glycol surge tank 425 is transferred to a coil within the liquid-liquid separator 116 to provide heat to the liquid within the liquid-liquid separator 116. In an illustrative embodiment, the glycol from the glycol surge tank 425 is between about 235° F. and about 245° F. From the coil within the liquid-liquid separator 116, the glycol is transferred to mix with the gas in the gas-glycol line 215 via the glycol line 405. In some embodiments, the coil within the liquid-liquid separator 116 is not used and glycol is transferred directly from the glycol surge tank 425 to the gas-glycol line 215 (although one or more pumps may be used). As illustrated in FIG. 4, a glycol pump 440 is used to transfer glycol through the glycol line 410 and the glycol line 405.

In an illustrative embodiment, the glycol that is mixed with the gas in the gas-glycol line 215 has a temperature of between 80° F. and 150° F. In alternative embodiments, the glycol has a temperature less than 80° F. or greater than 150° F. In an illustrative embodiment, about 1 gallon to 4 gallons of glycol per minute is mixed with the gas in the gas-glycol line 215. For example, about 2 gallons of glycol per minute is mixed with the gas in the gas-glycol line 215. In an illustrative embodiment, the gas in the gas-glycol line 215 flows at a rate of about 500 MCFD to 10,000 MCFD. In alternative embodiments, the flowrate of the glycol can be less than 1 gallon per minute or greater than 4 gallons per minute. For example, the amount of glycol added to the gas-glycol line 215 can be proportional to the flowrate of the inlet gas 192. In some embodiments, the amount of glycol added to the gas-glycol line 215 is proportional to the flowrate of the inlet gas 192.

As discussed above with respect to the liquid-liquid separator 116, glycol entered into the gas-glycol line 215 is recovered from the bottom of the liquid-liquid separator 116. The relatively cold (and wet) glycol from the liquid-liquid separator 116 is transferred back to the glycol reboiler 435 via the glycol line 415. As illustrated in FIG. 4, in an illustrative embodiment, the relatively cold glycol is warmed via the heat exchanger 430 before entering back into the glycol reboiler 435. In an illustrative embodiment, the glycol from the glycol line 415 enters the glycol reboiler 435 at the top of a tower that includes packing. The packing can facilitate separation of the glycol from the water.

As mentioned above, the glycol reboiler 435 is used to warm glycol used within the system. In an illustrative embodiment, the glycol reboiler 435 is also used to dry the glycol. As the glycol is mixed with the gas in the gas-glycol line 215, the gas-liquid separator 114, and the liquid-liquid separator 116, the glycol can bond to water, thereby drying the process material. However, if the glycol becomes too saturated with water, the dehydration properties of glycol can be reduced and become less effective. Thus, the glycol reboiler 435 can be used to boil off water from the glycol. In an illustrative embodiment, the glycol reboiler 435 heats the glycol/water compound entered into the glycol reboiler 435 from the liquid-liquid separator 116 and the glycol can be dried, at least partially. In an illustrative embodiment, the glycol within the glycol surge tank 425 is (about) 75% glycol and (about) 25% water. In some embodiments, the water boiled off of the glycol is vented to the atmosphere. In alternative embodiments, the water is captured and processed (e.g., to remove hazardous materials from the water) or disposed of.

Glycol from the glycol reboiler 435 can be used to warm the process material in the tower 320 via the heat exchanger 315. Warm glycol can be transferred to and from the heat exchanger 315 via the glycol line 420. The glycol pump 445 can be used to transfer the glycol through the glycol line 420. For example, about 40 gallons per minute to about 60 gallons per minute is pumped through the glycol pump 445.

Figure 5:
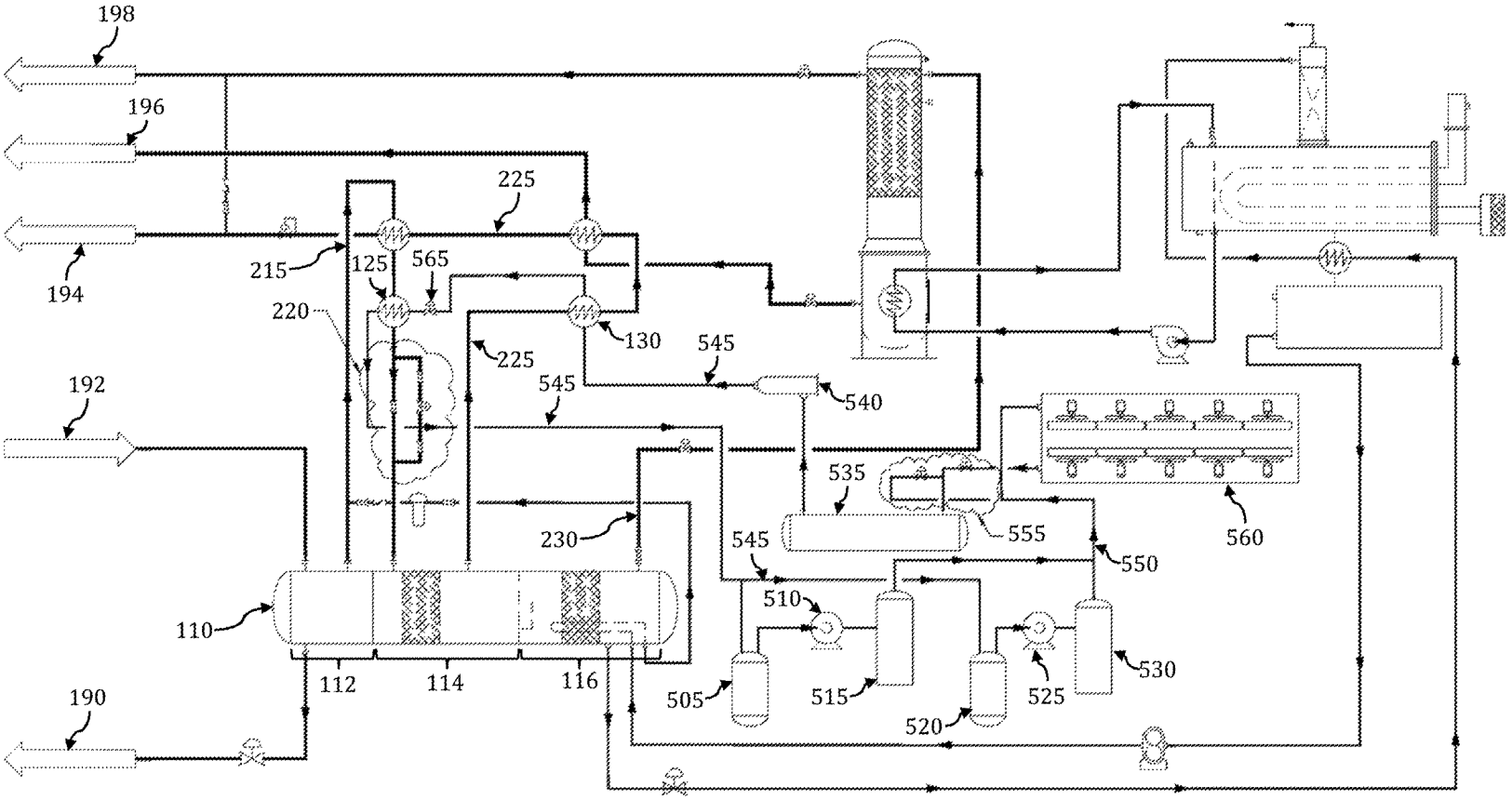

In some embodiments, a refrigerant and a refrigeration system are used to cool one or more of the process materials within the skid 100. Any suitable refrigerant can be used. For example, R-507A refrigerant can be used. In alternative embodiments, any suitable heat transfer fluid for transferring heat to the refrigerant can be used. Referring to FIG. 5, a condenser 560 is used to cool refrigerant. As illustrated in FIG. 5, the condenser 560 includes one or more fans. In alternative embodiments, any suitable method can be used to cool the refrigerant. In an illustrative embodiment, the refrigerant is cooled to a temperature between −30° F. and 10° F. at the heat exchanger 125. For example, the refrigerant can be cooled to a temperature of −20° F. In alternative embodiments, the refrigerant is cooled to a temperature below −30° F. or greater than 10° F. In an illustrative embodiment, the temperature of the refrigerant in the heat exchanger 125 is suitable to cool the gas/glycol mixture in the gas-glycol line 215 to a temperature of between 10° F. and −20° F.

The condenser 560 can be used to cool hot refrigerant vapor received from the compressor 510/oil separator 515 and the compressor 525/oil separator 530. In an illustrative embodiment, the temperature of the refrigerant received by the condenser 560 from the refrigerant line 550 has a temperature of about 170° F. In an illustrative embodiment, the condenser 560 has a cooling capacity of about 1,462,000 BTU/hour. The gaseous refrigerant from the refrigerant line 550 can be condensed to liquid form in the condenser 560. In an illustrative embodiment, the refrigerant leaving the condenser 560 to the liquid receiver 535 has a temperature of between about ambient temperature and about 15° F. above ambient temperature.

Compressed refrigerant from the condenser 560 can be transferred to the liquid receiver 535. The refrigerant can be transferred through the filter 540 to filter particles and/or impurities out of the refrigerant. For example, the filter 540 can remove water from the refrigerant. The refrigerant can be transferred through the refrigerant line 545 and through the heat exchanger 130 to cool the refrigerant and warm the gas in the natural gas line 225. As noted above, the gas in the natural gas line 225 has been cooled. In an illustrative embodiment, the gas leaving the gas-liquid separator 114 via the natural gas line 225 is at a temperature of about −20° F. Accordingly, as the cool gas passes through the heat exchanger 130, heat is transferred from the refrigerant in the refrigerant line 545 (which is at a temperature of about ambient as the refrigerant enters the heat exchanger 130) to the gas in the natural gas line 225 (which is at a temperature well below ambient). The refrigerant leaving the heat exchanger 130 can have a temperature of between about 32° F. to about 75° F. For example, the refrigerant leaving the heat exchanger 130 can have a temperature of about 55° F.

The refrigerant leaving the heat exchanger 130 passes through the control valve 565 to the heat exchanger 125 to cool the gas/glycol mixture in the gas-glycol line 215. The refrigerant on the upstream side of the control valve 565 (e.g., the refrigerant leaving the heat exchanger 130) is at a high pressure. The refrigerant on the downstream side of the control valve 565 (e.g., the refrigerant entering the heat exchanger 125) is at a low pressure. Thus, when the refrigerant is transitioned to a low pressure from the high pressure, the liquid refrigerant vaporizes and cools significantly. In an illustrative embodiment, the gaseous refrigerant downstream of the control valve 565 is at a temperature above the boiling point of the refrigerant for the pressure that the refrigerant is at. In an illustrative embodiment, the refrigerant is at a temperature of 10° F. higher than the boiling point of the refrigerant. For example, the refrigerant can change phases within the heat exchanger 125 (which can be an evaporator) thereby drawing heat from (and cooling) the gas/glycol mixture in the heat exchanger 125. The control valve 565 can be controlled to, for example, control the temperature of the refrigerant and/or the temperature of the gas/glycol mixture leaving the heat exchanger 125.

Any suitable control valve can be used for the control valve 565. For example, a control valve typically used in the oil and gas industry can be used. The control valve 565 can have a fast response time to an input control signal (received from any suitable source, such as a programmable logic controller). The control valve 565 can have a high flow rate. In an illustrative embodiment, the control valve 565 can be a control valve manufactured by Norriseal and/or Dover Corporation. In an illustrative embodiment, the control valve 565 maintains a 10° F. superheat in the cooling system. In alternative embodiments, any suitable amount of superheating can be used.

The refrigerant can travel through the refrigerant line 545 to the suction accumulator 505 and the suction accumulator 520. In an illustrative embodiment, the refrigerant in the refrigerant line 545 enters the heat exchanger 125 in liquid form and vaporizes within the heat exchanger 125. Transforming from liquid to gas can absorb a relatively high amount of heat, thereby causing a relatively high amount of cooling for the gas/glycol in the gas-glycol line 215. In some instances, some of the refrigerant remains in liquid form as it leaves the heat exchanger 125. In an illustrative embodiment, refrigerant in vapor form is transferred to the suction accumulator 505 and the suction accumulator 520. In an illustrative embodiment, the suction accumulator 505 and the suction accumulator 520 are used to prevent or reduce the amount of liquid entering the compressor 150 and the compressor 525, respectively.

In the embodiment illustrated in FIG. 5, two suction accumulators (505 and 520), two compressors (510 and 525), and two oil separators (515 and 530) are used. In alternative embodiments, any suitable number of components can be used. Any suitable arrangement of the accumulators, compressors, and oil separators are used. In an illustrative embodiment, one of the compressors is used to provide cooling for the refrigerant until a single compressor is not sufficient to provide adequate cooling at which point both compressors are used. Any suitable method of controlling the compressors may be used. For example, the output of the compressor 510 and/or the compressor 525 can be controlled to maintain a setpoint suction pressure of the compressor 510 and/or the compressor 525.

Refrigerant from the suction accumulator 505 and the suction accumulator 520 can be compressed by the compressor 510 and the compressor 525 and transferred to the oil separator 515 and oil separator 530, respectively. Any suitable size of compressors (e.g., the compressor 510 and the compressor 525) can be used. For example, each compressor can be between 125 horsepower and 750 horsepower. In alternative embodiments, each compressor can be less than 125 horsepower or greater than 750 horsepower. The compressors can be any suitable type of compressor, such as a screw compressor. In some instances, screw compressors have a small footprint for the power of the compressor. In some instances, screw compressors require less maintenance than other types of compressors.

In an illustrative embodiment, the size of the compressor 510 and the compressor 525 can be sufficient to cool the refrigerant in the refrigerant line 545 that enters the heat exchanger 125 to −30° F. (e.g., with ambient temperatures of 105° F.). In some embodiments, the compressor 510 and the compressor 525 together produce 700,000 BTU/hour of cooling capacity. In an illustrative example, the suction pressure, which is directly related to the pressure leaving the control valve 565. The higher that the suction pressure is, the higher that the cooling capacity is. In such an example, the compressor 510 and the compressor 525 together produce as much as 1,5000,000 BTU/hour of cooling capacity. Such a high capacity can be beneficial when the feed gas is rich and it is not necessary to cool refrigerant to −30° F. to achieve desired recovery. In an illustrative embodiment, using refrigerant temperatures of about −30° F. or less results in greater quantities of NGLs to liquify and results in 150% to 300% more NGLs captured from the inlet gas 192 compared traditional and/or other methods of capturing NGLs.

In some embodiments, using relatively high horsepower compressors allows the skid 100 to be used in hot climates (e.g., 105° F. atmospheric temperatures). If the refrigerant temperature at the heat exchanger 125 is significantly higher than −30° F., less NGLs are recovered from the inlet gas 192 and a lower quality of natural gas output 194 is produced because the natural gas output 194 will contain a higher percentage of NGLs.

Oil (e.g., compressor oil) can be removed from the refrigerant in the oil separator 515 and the oil separator 530. Refrigerant from the oil separator 515 and the oil separator 530 is transferred to the condenser 560 to be cooled. In an illustrative embodiment, refrigerant from the oil separator 515 and the oil separator 530 can be transferred to the liquid receiver 535 via the cold weather lines 555. In an illustrative embodiment, the cold weather lines 555 enables compressed refrigerant to bypass the condenser 560, for example, during periods of cold ambient temperature. The cold weather lines 555 can allow the system to maintain sufficient pressure for the liquid refrigerant to pass through the control valve 565. In some instances, the cold weather lines 555 can be used to maintain back pressure in the condenser 560 to maintain the pressure within the refrigeration loop.

As discussed above, glycol and refrigerant can be used to control the temperature of the various process materials within the skid 100. Any suitable temperature set points can be used for the various process materials and lines on the skid skid 100.

Figure 6:
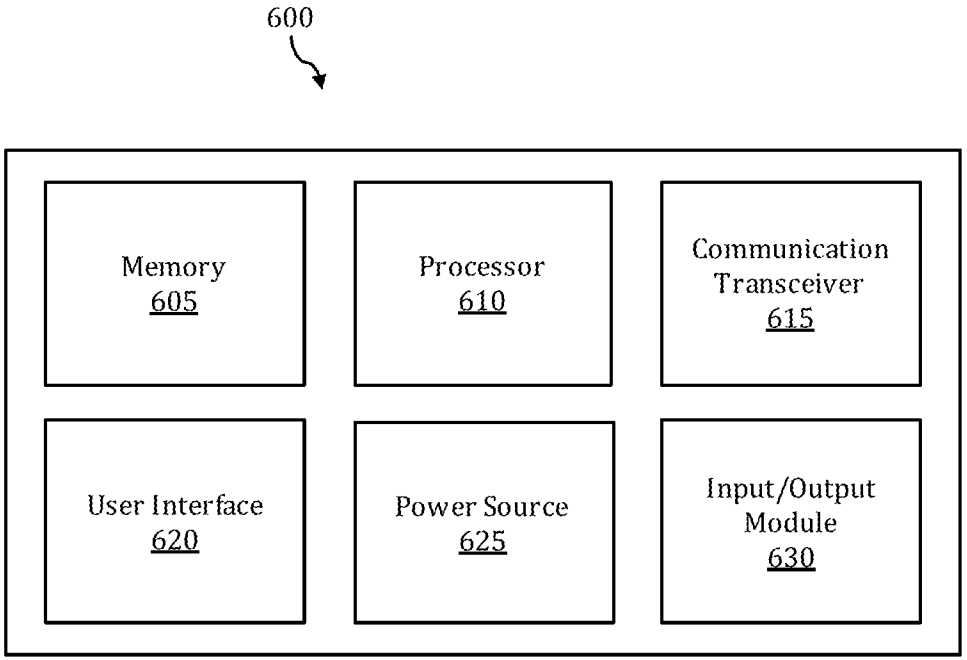
FIG. 6 is a block diagram of a computing device in accordance with an illustrative embodiment.

One or more of the processes described herein can be controlled by a computing device. For example, one or more of the processes can be automated. For example, various actuators such as pumps, solenoids, valves, etc. and various sensors such as temperature probes, pressure sensors, flow sensors, switches, etc. can be controlled and/or read by the computing device. FIG. 6 is a block diagram of a computing device in accordance with an illustrative embodiment. An illustrative computing device 600 includes a memory 605, a processor 610, a communications transceiver 615, a user interface 620, a power source 625, and an input/output module 630. In alternative embodiments, additional, fewer, and/or different elements may be used. The computing device 600 can be any suitable device described herein. For example, the computing device 600 can be a desktop computer, a laptop computer, a server, a specialized computing device, etc. In an illustrative embodiment, the computing device 600 is a programmable logic controller (PLC) or similar device. The computing device 600 can be used to implement one or more of the methods described herein.

In an illustrative embodiment, the memory 605 is an electronic holding place or storage for information so that the information can be accessed by the processor 610. The memory 605 can include, but is not limited to, any type of random access memory (RAM), any type of read only memory (ROM), any type of flash memory, etc. such as magnetic storage devices (e.g., hard disk, floppy disk, magnetic strips, etc.), optical disks (e.g., compact disk (CD), digital versatile disk (DVD), etc.), smart cards, flash memory devices, etc. The computing device 600 may have one or more computer-readable media that use the same or a different memory media technology. The computing device 600 may have one or more drives that support the loading of a memory medium such as a CD, a DVD, a flash memory card, etc.

In an illustrative embodiment, the processor 610 executes instructions. The instructions may be carried out by a special purpose computer, logic circuits, or hardware circuits. The processor 610 may be implemented in hardware, firmware, software, or any combination thereof. The term "execution" is, for example, the process of running an application or the carrying out of the operation called for by an instruction. The instructions may be written using one or more programming language, scripting language, assembly language, etc. The processor 610 executes an instruction, meaning that it performs the operations called for by that instruction. The processor 610 operably couples with the user interface 620, the communications transceiver 615, the memory 605, the input/output module 630, etc. to receive, to send, and to process information and to control the operations of the computing device 600 and the various components of the skid 100. The processor 610 may retrieve a set of instructions from a permanent memory device such as a ROM device and copy the instructions in an executable form to a temporary memory device that is generally some form of RAM. An illustrative computing device 600 may include a plurality of processors that use the same or a different processing technology. In an illustrative embodiment, the instructions may be stored in memory 605.

In an illustrative embodiment, the communications transceiver 615 is configured to receive and/or transmit information. In some embodiments, the communications transceiver 615 communicates information via a wired connection, such as an Ethernet connection, one or more twisted pair wires, coaxial cables, fiber optic cables, etc. In some embodiments, the communications transceiver 615 communicates information via a wireless connection using microwaves, infrared waves, radio waves, spread spectrum technologies, satellites, etc. The communications transceiver 615 can be configured to communicate with another device using cellular networks, local area networks, wide area networks, the Internet, etc. In some embodiments, one or more of the elements of the computing device 600 communicate via wired or wireless communications. In some embodiments, the communications transceiver 615 provides an interface for presenting information from the computing device 600 to external systems, users, or memory. For example, the communications transceiver 615 may include an interface to a display, a printer, a speaker, etc. In an illustrative embodiment, the communications transceiver 615 may also include alarm/indicator lights, a network interface, a disk drive, a computer memory device, etc. In an illustrative embodiment, the communications transceiver 615 can receive information from external systems, users, memory, etc.

In an illustrative embodiment, the user interface 620 is configured to receive and/or provide information from/to a user. The user interface 1030 can be any suitable user interface. The user interface 1030 can be an interface for receiving user input and/or machine instructions for entry into the computing device 600. The user interface 1030 may use various input technologies including, but not limited to, a keyboard, a stylus and/or touch screen, a mouse, a track ball, a keypad, a microphone, voice recognition, motion recognition, disk drives, remote controllers, input ports, one or more buttons, dials, joysticks, etc. to allow an external source, such as a user, to enter information into the computing device 600. The user interface 1030 can be used to navigate menus, adjust setpoints, adjust output values, adjust options, adjust settings, adjust display, etc.

The user interface 620 can be configured to provide an interface for presenting information from the computing device 600 to external systems, users, memory, etc. For example, the user interface 1030 can include an interface for a display, a printer, a speaker, alarm/indicator lights, a network interface, a disk drive, a computer memory device, etc. The user interface 1030 can include a color display, a cathode-ray tube (CRT), a liquid crystal display (LCD), a plasma display, an organic light-emitting diode (OLED) display, etc. In an illustrative embodiment, the user interface 620 includes a human-machine interface (HMI) that facilitates effective communication between a user and the computing device 600. For example, the HMI can be used to display one or more of the inputs received by the input/output module 630 and to receive (e.g., instructions for determining) one or more of the output values transmitted by the input/output module 630.

In an illustrative embodiment, the power source 625 is configured to provide electrical power to one or more elements of the computing device 600. In some embodiments, the power source 625 includes an alternating power source, such as available line voltage (e.g., 120 Volts alternating current at 60 Hertz in the United States). The power source 625 can include one or more transformers, rectifiers, etc. to convert electrical power into power useable by the one or more elements of the computing device 600, such as 1.5 Volts, 8 Volts, 12 Volts, 24 Volts, etc. The power source 625 can include one or more batteries.

In an illustrative embodiment, the computing device 600 includes an input/output module 630. In other embodiments, input/output module 630 is an independent device and is not integrated into the computing device 600. The input/output module 630 can be configured to receive input from one or more sensors, switches, signals, etc. from the skid 100. Illustrative inputs can include discrete inputs (e.g., 120 VAC) and/or analog inputs (e.g., 0-20 mA, 4-20 mA, etc.). Examples of discrete inputs include whether a valve is open or closed, whether a motor is on or off, whether a switch is tripped (e.g., a pressure switch), etc. Examples of analog inputs include temperature, pressure, location (e.g., percent of valve travel), liquid level, amps, volts, etc. The input/output module 630 can be configured to transmit outputs to one or more actuators, valves, motors, pumps, etc. Illustrative outputs can include discrete outputs (e.g., heat exchanger 120 VAC) and/or analog outputs (e.g., 0-20 mA, 4-20 mA, etc.). Examples of discrete outputs include commands to open or close a valve, turn on or off a pump/motor, etc. Examples of analog outputs include commands for percent of valve travel, setpoints for controllers, etc. The input/output module 630 can be used to communicate with any suitable device associated with the skid 100.

Figure 7:
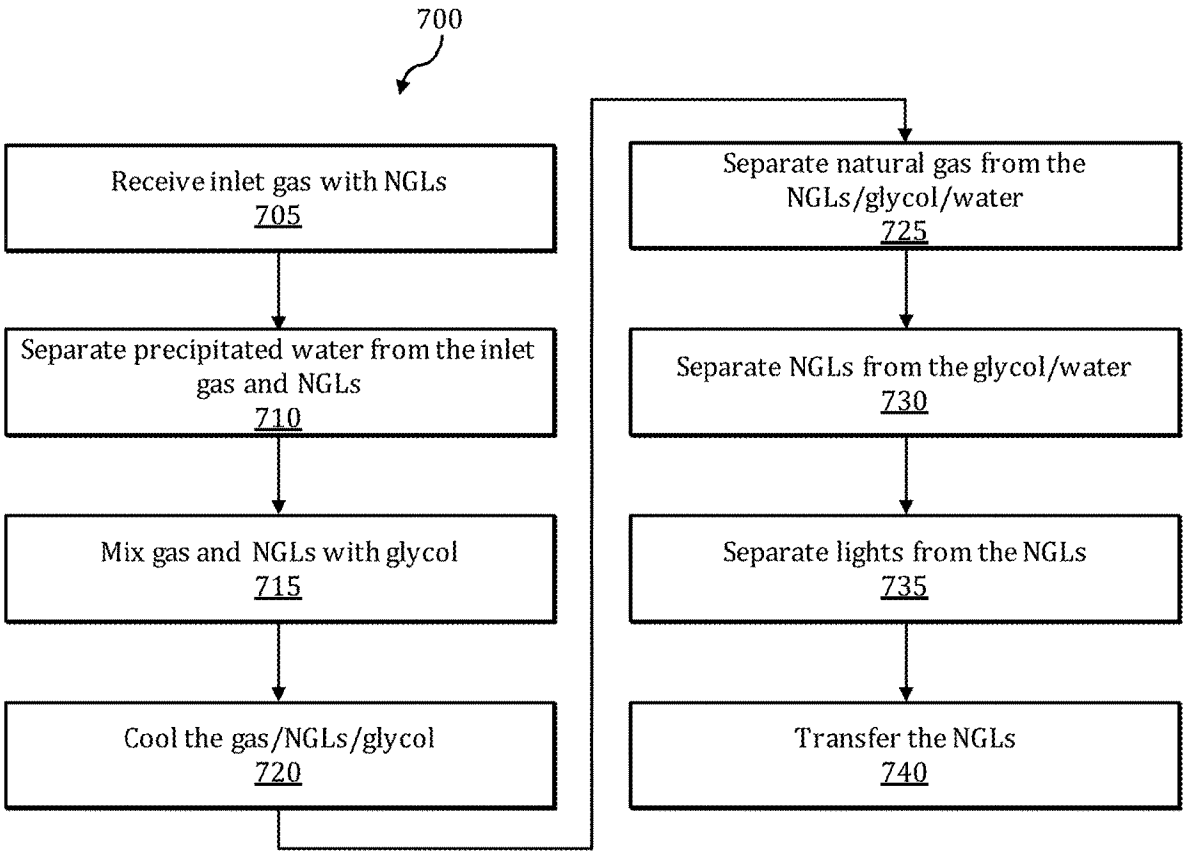
FIG. 7 is a flow diagram of a method of recovering natural gas liquids in accordance with an illustrative embodiment.

FIG. 7 is a flow diagram of a method of recovering natural gas liquids in accordance with an illustrative embodiment. In alternative embodiments, additional, fewer, and/or different operations may be performed. Also, the use of a flow diagram is not meant to be limiting with respect to the order or flow of operations. In an illustrative embodiment, method 700 is implemented using a computing device such as the computing device 600.

In an operation 705, inlet gas with NGLs is received. In an illustrative embodiment, the inlet gas is received at a water knock-out section of a separator. In some embodiments, the inlet gas with NGLs includes water. In an operation 710, precipitated water is separated from the inlet gas and the NGLs. In an embodiment, water from the inlet gas with NGLs received in the operation 705 settles at the bottom of the water knock-out section. The inlet gas and the NGLs rise to the top of the water knock-out section.

In an operation 715, the gas and the NGLs is mixed with glycol. In an illustrative embodiment, the gas with the NGLs is taken from the top of the water knock-out section of the separator and transferred through a pipe. The glycol is mixed with the gas and NGLs in the pipe. In alternative embodiments, the gas with the NGLs is taken from the top of the water knock-out section of the separator and transferred to the gas-liquid separator of the separator and glycol is mixed with the gas and the NGLs in the gas-liquid separator. Once mixed, the glycol absorbs water in the gas and the NGLs.

In an operation 720, the gas, NGLs, and glycol mixture is cooled. Cooling the gas, NGLs, and glycol mixture causes hydrocarbons such as pentanes, butanes, propanes, etc. to condense into liquid form. In an illustrative embodiment, the mixture is cooled using a heat exchanger such as heat exchanger 125. In some embodiments, additional and/or different heat exchangers are used (e.g., heat exchanger 120).

In an operation 725, natural gas is separated from the NGLs, the glycol, and the water. In an illustrative embodiment, the gas, NGLs, and glycol mixture produced in operation 715 is transferred to the gas-liquid separator. While in the gas-liquid separator, materials with a relatively high boiling point (e.g., gasses such as natural gas) rise to the top of the gas-liquid separator 114 and materials with a relatively low boiling point (e.g., liquids such as NGLs, glycol, and water) settle on the bottom of the gas-liquid separator. In an illustrative embodiment, the natural gas is transported from the top of the gas-liquid separator 114 to a storage system, a pipeline, a burner, etc.

In an operation 730, NGLs are separated from the glycol and water. In an illustrative embodiment, the liquid from the gas-liquid separator is transported to a liquid-liquid separator. Within the liquid-liquid separator, the NGLs rise to the top of the liquid and the glycol and water sink to the bottom of the liquid. In an illustrative embodiment, the glycol and water can be transported from the bottom of the liquid-liquid separator to a dehydrator to "clean" the glycol for reuse as a desiccation material (e.g., using the glycol reboiler 435).

In an operation 735, the lights material is separated from the NGLs. The lights material can include methane, ethane, etc. In an illustrative embodiment, liquid from the top layer of the liquid-liquid separator (e.g., the NGLs layer) is transported to a tower in which the liquid is heated (e.g., via heat exchanger 315). Compounds within the liquid that have a relatively high boiling point (e.g., the lights material such as methane, ethane, etc.) evaporate from the liquid. The gaseous lights material can be transported to a storage system, a pipeline, a burner, etc. The remaining liquid is the NGLs. In an operation 740, the NGLs are transferred. The NGLs can be transferred to any suitable location, such as a storage system, a pipeline, a tanker, a burner, etc. In an illustrative embodiment, the NGLs are sold as a product.

Example #1

In an example, lean inlet gas can be processed through the skid 100. The lean inlet gas can enter into the skid 100 via the inlet gas 192. The components of the lean inlet gas are shown in Table 1 below.

TABLE 1

| Components of lean inlet gas | |
|---|---|
| Component | Percentage (mol %) |
| Nitrogen | 0.86406 |
| Carbon Dioxide | 0.91600 |
| Methane | 87.25514 |
| Ethane | 5.96475 |
| Propane | 2.30328 |
| i-Butane | 0.21924 |
| n-Butane | 0.73456 |
| i-Pentane | 0.34818 |
| n-Pentane | 0.29214 |
| Hexane | 1.09765 |
| Water | 0.00500 |
| Total | 100.00000 |

The lean inlet gas has a temperature of about 90° F. at a pressure of about 1115 psia. The lean inlet gas flows through the inlet gas 192 at a standard vapor volumetric flowrate of about 5,000 MSCFD. The lean inlet gas has a gross ideal gas heating value of about 1,154 British thermal units per cubic foot (BTU/ft$^3$).

The lean inlet gas is processed through the skid 100. The components of the natural gas output 194 resulting from processing the lean inlet gas are shown in Table 2 below.

TABLE 2

| Components of natural gas output | |
|---|---|
| Component | Percentage (mol %) |
| Nitrogen | 0.92012 |
| Carbon Dioxide | 0.89248 |
| Methane | 90.36774 |
| Ethane | 5.39228 |
| Propane | 1.65524 |
| i-Butane | 0.11897 |
| n-Butane | 0.33942 |
| i-Pentane | 0.10587 |
| n-Pentane | 0.07638 |
| Hexane | 0.13124 |
| Water | 0.00027 |
| Total | 100.00000 |

As shown in Table 2, the natural gas output 194 can be mostly comprised of methane and can have less than 0.001% water. The natural gas output 194 has a temperature of about 75° F. and a pressure of about 1,092 psia. The natural gas output 194 has a standard vapor volumetric flowrate of about 4,601 MSCFD. The gross ideal gas heating value is about 1,078 BTU/ft$^3$.

The components of the natural gas liquids output 196 resulting from processing the lean inlet gas are shown in Table 3 below.

TABLE 3

| Components of NGLs stream | |
|---|---|
| Component | Volume (Gallons per day) |
| Nitrogen | 2.36946E−09 |
| Carbon Dioxide | 0.02680 |
| Methane | 0.00241 |
| Ethane | 146.89985 |
| Propane | 934.28168 |
| i-Butane | 172.37283 |

TABLE 3-continued

| Components of NGLs stream | |
|---|---|
| Component | Volume (Gallons per day) |
| n-Butane | 648.14213 |
| i-Pentane | 453.92151 |
| n-Pentane | 398.95736 |
| Hexane | 2001.44135 |
| Water | 9.45116E−07 |
| Total | 4756.04593 |

As shown in Table 3, the natural gas liquids output 196 has (virtually) no methane or water. The natural gas liquids output 196 is primarily hexane and propane with ethane, butanes, and pentanes. The total amount of NGLs through the natural gas liquids output 196 per day is about 4,755 gallons. The natural gas liquids output 196 has a temperature of about 16° F. at a pressure of about 245 psia.

The components of the lights output 198 resulting from processing the lean inlet gas are shown in Table 4 below.

TABLE 4

| Components of lights stream | |
|---|---|
| Component | Percentage (mol %) |
| Nitrogen | 0.33308 |
| Carbon Dioxide | 1.75068 |
| Methane | 78.54638 |
| Ethane | 17.10119 |
| Propane | 1.91959 |
| i-Butane | 0.07936 |
| n-Butane | 0.19184 |
| i-Pentane | 0.03622 |
| n-Pentane | 0.02251 |
| Hexane | 0.01868 |
| Water | 0.00046 |
| Total | 100.00000 |

As shown in Table 4, the primary components of the lights output 198 is methane and ethane. The lights output 198 has a temperature of about −34° F. at a pressure of about 250 psia. The lights output 198 flows at a rate of 261 MSCFD and has a gross ideal gas heating value of 1,156 BTU/ft$^3$.

Example #2

In an example, lean inlet gas can be processed through the skid 100. The lean inlet gas can enter into the skid 100 via the inlet gas 192. The components of the lean inlet gas are shown in Table 1 above. The lean inlet gas has a temperature of about 90° F. at a pressure of about 1115 pounds per square inch absolute (psia). The lean inlet gas flows through the inlet gas 192 at a standard vapor volumetric flowrate of about 5,000 MSCFD. The lean inlet gas has a gross ideal gas heating value of about 1,154 British thermal units per cubic foot (BTU/ft$^3$).

The components of the natural gas liquids output 196 resulting from processing the lean inlet gas are shown in Table 3 above. As shown in Table 3, the natural gas liquids output 196 has (virtually) no methane and a minimal amount of ethane. The total amount of NGLs through the natural gas liquids output 196 per day is 4,756 gallons. The natural gas liquids output 196 has a temperature of about 16° F. at a pressure of about 245 psia.

The lights in the lights line 305 from the tower 320 are mixed with the gas from the natural gas line 225. The components of the natural gas output 194 are shown in Table 5 below.

TABLE 5

| Components of mixed residue gas and natural gas | |
|---|---|
| Component | Percentage (mol %) |
| Nitrogen | 0.888607 |
| Carbon Dioxide | 0.938545 |
| Methane | 89.73317 |
| Ethane | 6.020817 |
| Propane | 1.66943 |
| i-Butane | 0.116848 |
| n-Butane | 0.331495 |
| i-Pentane | 0.102129 |
| n-Pentane | 0.073485 |
| Hexane | 0.125197 |
| Water | 0.000281 |
| Total | 100.00000 |

As shown in Table 5, the mixed natural gas and lights comprises about 90% methane.

Example #3

In an example, rich inlet gas can be processed through the skid 100. The rich inlet gas can enter into the skid 100 via the inlet gas 192. The components of the rich inlet gas are shown in Table 5 below.

TABLE 5

| Components of rich inlet gas | |
|---|---|
| Component | Percentage (mol %) |
| Nitrogen | 1.67195 |
| Carbon Dioxide | 0.50722 |
| Methane | 40.93930 |
| Ethane | 16.02101 |
| Propane | 34.10052 |
| i-Butane | 1.02855 |
| n-Butane | 3.45798 |
| i-Pentane | 0.67380 |
| n-Pentane | 0.99145 |
| Hexane | 0.59321 |
| Water | 0.01500 |
| Total | 100.00000 |

The rich inlet gas has a temperature of about 100° F. at a pressure of about 615 psia. The rich inlet gas flows through the inlet gas 192 at a standard vapor volumetric flowrate of about 3,000 MSCFD. The rich inlet gas has a gross ideal gas heating value of about 1,804 BTU/ft$^3$. The rich inlet gas is processed through the skid 100. The components of the natural gas output 194 resulting from processing the rich inlet gas are shown in Table 6 below.

TABLE 6

| Components of natural gas output | |
|---|---|
| Component | Percentage (mol %) |
| Nitrogen | 4.01263 |
| Carbon Dioxide | 0.64430 |
| Methane | 76.23244 |
| Ethane | 11.45636 |
| Propane | 7.38228 |

TABLE 6-continued

| Components of natural gas output | |
|---|---|
| Component | Percentage (mol %) |
| i-Butane | 0.07741 |
| n-Butane | 0.17161 |
| i-Pentane | 0.01007 |
| n-Pentane | 0.01158 |
| Hexane | 0.00029 |
| Water | 0.00103 |
| Total | 100.00000 |

As shown in Table 6, the natural gas output 194 can be mostly comprised of methane but can be about 13% ethane and about 10% propane. The natural gas output 194 has a temperature of about 100° F. and a pressure of about 592 psia. The natural gas output 194 has a standard vapor volumetric flowrate of about 1,058 MSCFD. The gross ideal gas heating value is about 1,167 BTU/ft$^3$.

The components of the natural gas liquids output 196 resulting from processing the rich inlet gas are shown in Table 7 below.

TABLE 7

| Components of NGLs stream | |
|---|---|
| Component | Volume (Gallons per day) |
| Nitrogen | 6.66273E−08 |
| Carbon Dioxide | 0.03781 |
| Methane | 0.01106 |
| Ethane | 525.02591 |
| Propane | 11284.24612 |
| i-Butane | 389.46078 |
| n-Butane | 1153.73087 |
| i-Pentane | 188.44021 |
| n-Pentane | 253.12750 |
| Hexane | 40.62036 |
| Water | 2.78353E−06 |
| Total | 13834.70063 |

As shown in Table 7, the natural gas liquids output 196 is mostly propane. The total amount of NGLs through the natural gas liquids output 196 per day is about 13,835 gallons. The system produces about 870 gallons per day of condensate. The natural gas liquids output 196 has a temperature of about 103° F. at a pressure of about 245 psia.

The components of the lights output 198 resulting from processing the lean inlet gas are shown in Table 8 below.

TABLE 8

| Components of lights stream | |
|---|---|
| Component | Percentage (mol %) |
| Nitrogen | 0.82267 |
| Carbon Dioxide | 0.92280 |
| Methane | 46.53809 |
| Ethane | 33.71603 |
| Propane | 17.46291 |
| i-Butane | 0.15769 |
| n-Butane | 0.33955 |
| i-Pentane | 0.01842 |
| n-Pentane | 0.02032 |
| Hexane | 0.00043 |
| Water | 0.00109 |
| Total | 100.00000 |

As shown in Table 8, the primary components of the lights output 198 is methane, ethane, and propane. The lights output 198 has a temperature of about 20° F. at a pressure of about 250 psia. The lights output 198 flows at a rate of 679 MSCFD and has a gross ideal gas heating value of 1,523 BTU/ft$^3$.

In an illustrative embodiment, any of the operations described herein can be implemented at least in part as computer-readable instructions stored on a computer-readable memory. Upon execution of the computer-readable instructions by a processor, the computer-readable instructions can cause a node to perform the operations.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B." Further, unless otherwise noted, the use of the words "approximate," "about," "around," "substantially," etc., mean plus or minus ten percent.

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. A system comprising:

a water knock-out tank configured to receive a fluid material, wherein water from the fluid material settles on the bottom of the water knock-out tank;

a mixing pipe configured to mix a glycol with the fluid material transferred from the water knock-out tank;

a first heat exchanger configured to cool the mixed fluid material and glycol;

a gas-liquid separator configured to separate gaseous components and liquid components of the mixed fluid material and glycol that has been cooled;

a liquid-liquid separator configured to separate the liquid components of the mixed fluid material and glycol that has been cooled by density; and a fractional distillation column configured to heat a first liquid from the liquid-liquid separator, wherein heating the first liquid from the liquid-liquid separator causes a first portion of the first liquid to gasify, and wherein a second portion of the first liquid from the liquid-liquid separator remains liquid and is natural gas liquids.

2. The system of claim 1, wherein the first heat exchanger is configured to cool the mixed fluid material and glycol to a temperature between −30° F. and 10° F.

3. The system of claim 1, further comprising a third heat exchanger configured to transfer heat from the mixed fluid material and glycol in the mixing pipe to the gaseous components of the mixed fluid material from the gas-liquid separator.

4. The system of claim 1, further comprising a fourth heat exchanger configured to transfer heat from the second portion of the first liquid from the liquid-liquid separator to the gaseous components of the mixed fluid material from the gas-liquid separator.

5. The system of claim 1, wherein a majority of the gaseous component of the mixed fluid material and glycol from the gas-liquid separator comprises methane, ethane, and/or propane.

6. The system of claim 1, wherein a majority of the gaseous component of the mixed fluid material and glycol from the gas-liquid separator comprises methane.

7. The system of claim 1, wherein a majority of the first liquid from the liquid-liquid separator comprises methane, ethane, propane, and/or pentane.

8. The system of claim 1, wherein the second portion of the first liquid from the liquid-liquid separator comprises less than 4 mole % ethane.

9. The system of claim 1, wherein the first heat exchanger is configured to cool the mixed fluid material and glycol to a temperature above −40° F.

10. The system of claim 9, wherein the first heat exchanger is configured to cool the mixed fluid material and glycol to a temperature above −35° F.

11. The system of claim 1, further comprising a reboiler configured to heat a second liquid from the liquid-liquid separator, wherein heating the second liquid causes water to evaporate out of the second liquid.

12. The system of claim 11, wherein the first liquid from the liquid-liquid separator has a lesser density than the second liquid from the liquid-liquid separator.

13. The system of claim 11, wherein the reboiler is further configured to provide glycol to the mixing pipe via a glycol pipe.

14. The system of claim 13, wherein the second liquid from the liquid-liquid separator comprises a higher mole percentage of water than liquid in the glycol pipe.

15. A method comprising:

separating free water from a fluid material, wherein the fluid material comprises natural gas and natural gas liquids;

mixing the fluid material with a glycol;

cooling the mixed fluid material and glycol;

separating gaseous components and liquid components of the mixed fluid material and glycol that has been cooled;

separating, by density, the liquid components of the mixed fluid material and glycol that has been cooled; and heating a first liquid of the liquid components thereby causing a first portion of the first liquid to gasify, wherein a second portion of the first liquid to remain liquid, and wherein the second portion of the first liquid is natural gas liquids.

16. The method of claim 15, further comprising heating, by a reboiler, a second liquid from the liquid components of the mixed fluid material and glycol thereby causing water to evaporate out of the second liquid.

17. The method of claim 15, wherein said cooling the mixed fluid material and glycol comprises cooling the mixed fluid material and glycol to a temperature above −40° F.

18. The method of claim 15, wherein said cooling the mixed fluid material and glycol comprises cooling the mixed fluid material and glycol to a temperature above −35° F.

19. The method of claim 15, wherein said cooling the mixed fluid material and glycol comprises cooling the mixed fluid material and glycol to a temperature between −30° F. and 10° F.

20. The method of claim 15, wherein said cooling the mixed fluid material and glycol comprises cooling the mixed fluid material and glycol to a temperature that does not condense a majority of ethane in the mixed fluid material and glycol.

* * * * *